US009239587B2

(12) United States Patent
Takatsu et al.

(10) Patent No.: US 9,239,587 B2
(45) Date of Patent: Jan. 19, 2016

(54) SHAFT SLIP-OFF STOPPING STRUCTURE AND SWITCH HAVING THE SAME

(71) Applicant: TOYO DENSO KABUSHIKI KAISHA, Tokyo (JP)

(72) Inventors: Yukiyoshi Takatsu, Tsurugashima (JP); Shingo Miyayama, Tsurugashima (JP)

(73) Assignee: TOYO DENSO KABUSHIKI KAISHA, Tokyo (JP)

( * ) Notice: Subject to any disclaimer, the term of this patent is extended or adjusted under 35 U.S.C. 154(b) by 73 days.

(21) Appl. No.: 14/186,234

(22) Filed: Feb. 21, 2014

(65) Prior Publication Data

US 2014/0238829 A1 Aug. 28, 2014

(30) Foreign Application Priority Data

Feb. 28, 2013 (JP) ..... 2013-38288

(51) Int. Cl.

| | |
|---|---|
| ***G05G 1/12*** | (2006.01) |
| *H01H 3/08* | (2006.01) |
| *H01H 3/12* | (2006.01) |

(52) U.S. Cl.

CPC .. *G05G 1/12* (2013.01); *H01H 3/08* (2013.01); *H01H 3/12* (2013.01); *Y10T 74/20762* (2015.01)

(58) Field of Classification Search

CPC ..... H01H 3/12; H01H 3/08
USPC ..... 200/11 R, 237, 564, 336
See application file for complete search history.

(56) References Cited

FOREIGN PATENT DOCUMENTS

| | | | |
|---|---|---|---|
| JP | S58-27453 Y | | 6/1983 |
| JP | 2002-058199 A | * | 2/2002 |
| JP | 3796051 B | | 7/2006 |
| JP | 4548911 B | | 9/2010 |

* cited by examiner

*Primary Examiner* — Edwin A. Leon
*Assistant Examiner* — Iman Malakooti
(74) *Attorney, Agent, or Firm* — Bruzga & Associates; Charles E. Bruzga; Jay S. Pattumudi

(57) ABSTRACT

Disclosed is a shaft inserted member into which a shaft is inserted in a relatively movable manner, and a locking mechanism provided in the shaft inserted member. The tip portion of the shaft includes a locking step portion formed by providing an annular groove or a ring-shaped projection portion. The locking mechanism includes at least two locking pieces arranged around the shaft at an equal interval. The shaft is stopped from slipping off by a tip portion of each of the tip locking portions abutting on the locking step portion. The locking piece can receive the force in a pulling direction in a length direction of the locking piece, whereby a load can be reduced. That is, sufficient strength can be maintained.

5 Claims, 7 Drawing Sheets

SHAFT SLIP-OFF STOPPING STRUCTURE AND SWITCH HAVING THE SAME

FIELD OF THE INVENTION

The field relates to a shaft slip-off stopping structure and a switch having the shaft slip-off stopping structure.

BACKGROUND OF THE INVENTION

In JP 58-27453 Y, there is disclosed a structure (hereinafter referred to as a first conventional structure) in which a shaft, which is bifurcated and can be tapered by narrowing down a space therein, is elastically returned after passing through a hole in a body and is stopped from slipping off by a slip-off stopping lock provided at a tip portion thereof.

In JP 3796051 B, there is described a structure (hereinafter referred to as a second conventional structure) in which a shaft is provided with an arrowhead shaped engaging projection part at a tip thereof, and by closing a slit formed inside the engaging projection part, the shaft is configured to pass through an axis insertion hole in an elastically returnable manner.

Furthermore, in JP 4548911 B, there is introduced a structure (hereinafter referred to as a third conventional structure) in which a mushroom-shaped motor shaft has an abutting end part and a small-diameter shaft, and the abutting end part thereof is supported by a thrust washer. At this time, inside a small-diameter groove part surrounding the small-diameter shaft in a circumferential direction, there is a clip facing to stop the abutting end part from slipping off.

This clip includes four extension parts projecting out from a tubular base part toward a center in a transverse direction (a shaft-crossing direction). Each of the extension parts is elastically deformable, and by a tip of each of the extension parts, a space having a smaller diameter than that of the abutting end part is partitioned at the center.

Each of the extension parts, being pushed against the abutting end part, is deformed to allow for passage of the abutting end part, and is elastically returned after the passage so as to be engaged when the abutting end part is pulled up.

In other words, it is configured not to be engaged when it is supported by the thrust washer.

There are problems with the conventional structures, which are discussed as follows.

Since the shaft is bifurcated (and there is a wide space between the bifurcated parts) in the first conventional structure, there is a fear that overall shaft strength may be insufficient. It has a disadvantage in that the shaft may easily slip off in a case where one of the bifurcated parts of the shaft is damaged The engaging projection part according to the second conventional structure is divided into two parts by the existence of a slit. Therefore, similar to the problem in the first conventional structure, there is a problem of insufficient strength and in that it may easily slip off.

The clip according to the third conventional structure is not related to a rotation of the shaft in the first place. The thrust washer is playing that role.

Therefore, there is a problem in that the number of components is increased.

Furthermore, it is necessary for the clip projecting in the transverse direction to receive a force from the shaft in a direction of pulling out with a thickness direction thereof.

There remains a need for improved shaft slip-off stopping structures and switches having such structures.

SUMMARY OF THE INVENTION

In view of the above-described problems of the prior art, as discussed in the above-referenced background, the present invention aims at providing a shaft slip-off stopping structure, which has sufficient strength, is difficult to be pulled out, and further can be constituted with the minimum number of components, and a switch having the same.

To solve the above-described problems, the present invention has the following exemplary configuration.

Note that a definition of a term and the like provided for describing any of the aspects of the present invention shall also be applied to another aspect of the present invention where possible, regardless of an order of description.

Characteristics of the Present Invention According to a First Aspect

A shaft slip-off stopping structure according to a first aspect of the present invention includes: a shaft inserted member into which a shaft is inserted in a relatively movable manner; and a locking mechanism provided in the shaft inserted member, the shaft slip-off stopping structure being configured between a tip portion of the shaft and the locking mechanism in a direction opposite to an insertion direction, wherein the tip portion of the shaft includes a locking step portion formed by providing an annular groove or a ring-shaped projection portion, the locking mechanism includes at least two locking pieces arranged around the shaft at an equal interval, each of the locking pieces includes a base part extending along a length direction of the shaft, and a tip locking portion bending from the base part and extending toward a center direction, and the shaft is stopped from slipping off by a tip portion of each of the tip locking portions abutting on the locking step portion.

Characteristics of the Present Invention According to a Second Aspect

A switch according to a second aspect of the present invention (hereinafter referred to as a switch in the second aspect as appropriate) is the switch having a structure according to the first aspect. The switch includes: an operation part integrally provided in a base end portion on an opposite side of the tip portion of the shaft; and a switch main body inside which the shaft inserted member is provided.

Characteristics of the Present Invention According to a Third Aspect

A switch according to a third aspect of the present invention (hereinafter referred to as a switch in the third aspect as appropriate) is the switch according to the second aspect wherein the shaft is configured to be rotatable relative to the switch main body and the locking mechanism by operation of the operation part.

Characteristics of the Present Invention According to a Fourth Aspect

A switch according to a fourth aspect of the present invention (hereinafter referred to as a switch in the fourth aspect as appropriate) is the switch according to the second aspect wherein the shaft is configured to be retractable relative to the switch main body and the locking mechanism by operation of the operation part.

Characteristics of the Present Invention According to a Fifth Aspect

A switch according to a fifth aspect of the present invention (hereinafter referred to as a switch in the fifth aspect as appropriate) the switch according to the fourth aspect wherein the shaft inserted member has a movable contact point configured to move in sync with retraction of the shaft.

According to one example of the present invention, a slip-off stopping structure and a switch having the same can be provided with sufficient strength, can be made to be difficult to slip off, and further can be constituted with the minimum number of components.

Therefore, it is no longer necessary to use a conventionally-used slip-off stopping member such as an E-ring, for example, whereby it is possible to save labor and reduce costs in manufacturing.

BRIEF DESCRIPTION OF THE DRAWINGS

Further features and advantages of the invention will become apparent from reading the following detailed description in conjunction with the following drawings, in which like reference numbers refer to like parts.

DETAILED DESCRIPTION

The examples and drawings provided in the detailed description are merely examples, and should not be used to limit the scope of the claims in any claim construction or interpretation.

An embodiment for carrying out the present invention (hereinafter referred to as this embodiment) is described with reference to the drawings.

In this embodiment, a switch is given as an applicable example of a shaft slip-off stopping structure.

The switch given herein falls into two types, one is a rotary type switch and other is a push type switch.

Schematic Structure of the Rotary Type Switch

Figure 1:
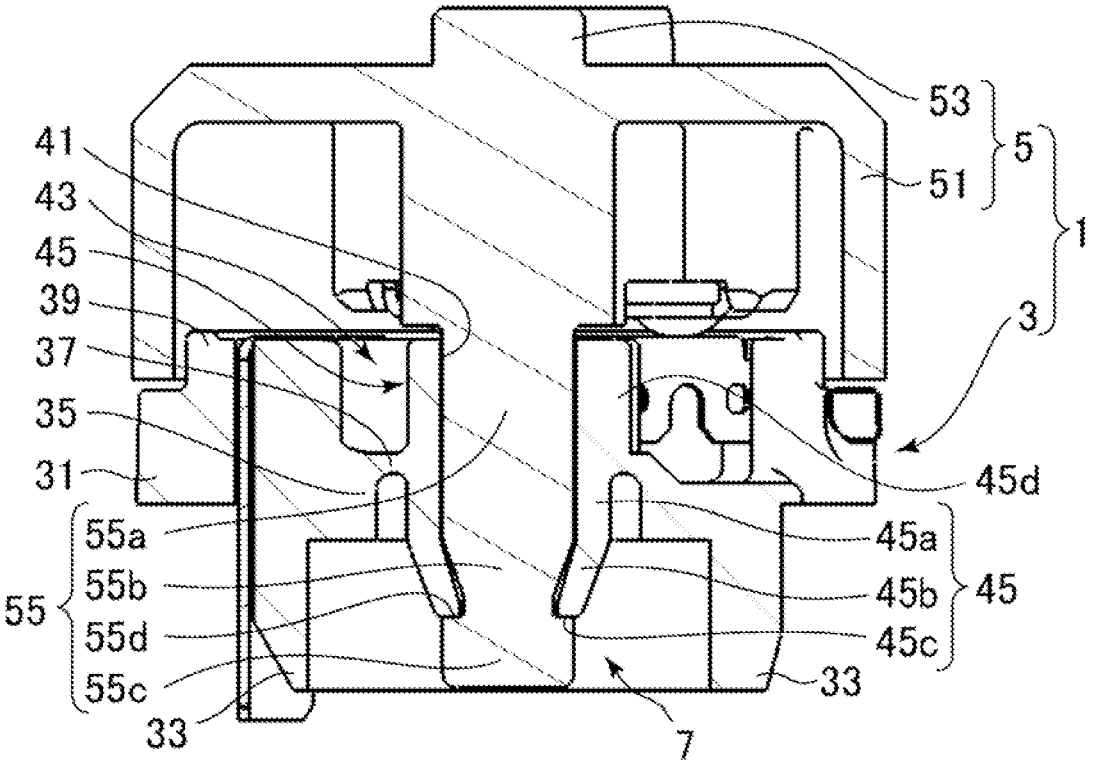
FIG. 1 is a longitudinal sectional view of a switch (sectional view taken along A-A in FIG. 2)
Figure 3:
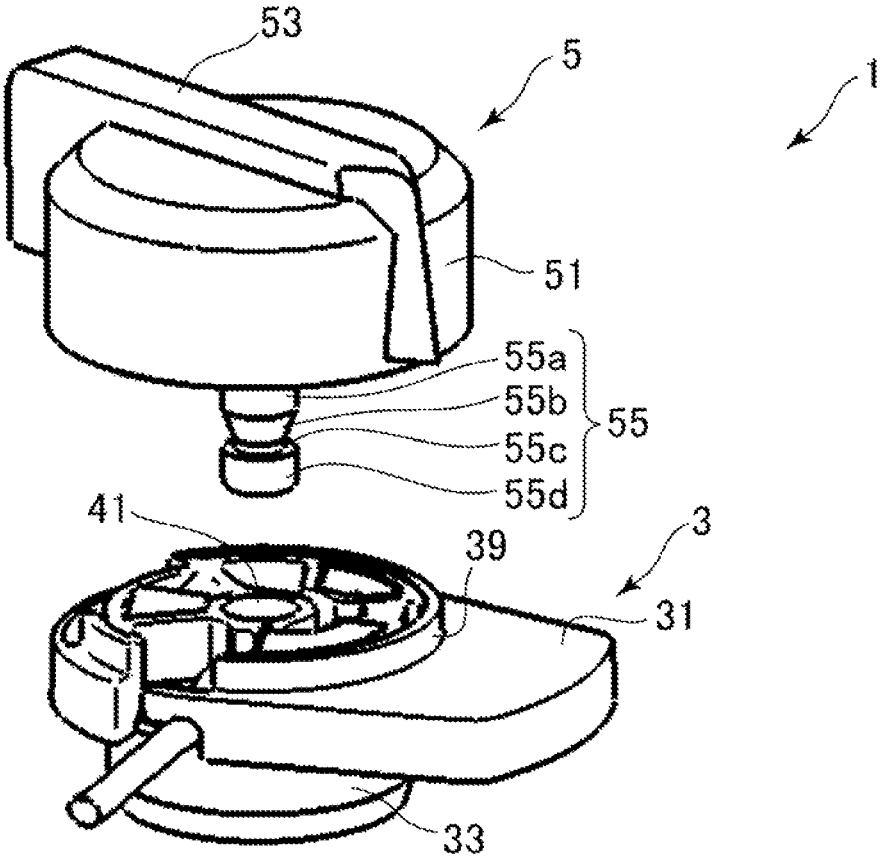
FIG. 3 is an exploded perspective view of the switch.

As illustrated in FIGS. 1 and 3, a switch 1 is a rotary type switch schematically including a resin switch main body 3 and a resin operation part 5 rotatably integrated into the switch main body 3.

Schematic Structure of the Switch Main Body

Figure 4:
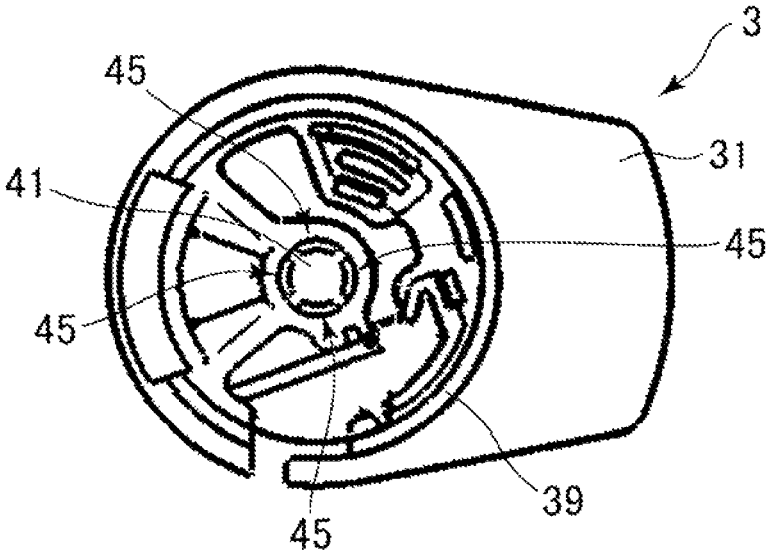
FIG. 4 is a planar view of a switch main body.
Figure 5:
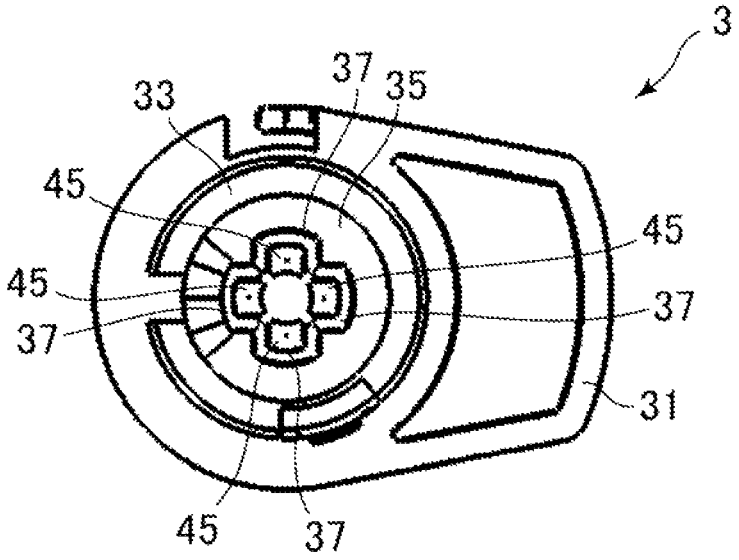
FIG. 5 is a bottom view of the switch main body.

As illustrated in FIG. 1 and FIGS. 3 to 4, the switch main body 3 includes: a flange part 31 serving as a base; a cylindrical partition wall 33 projecting downward from an undersurface of the flange part 31; a thick plate portion 35 extending from inside the cylindrical partition wall 33 toward a center; and a locking mechanism 43 supported by a thin plate portion 37 extending further toward the center from the thick plate portion 35.

The locking mechanism 43, as described below, constitutes a part on a side of the switch main body 3 to be a part of a shaft slip-off stopping structure 7.

On the other hand, on an upper surface of the flange part 31, a flat cylindrical part 39 on which a terminal for controlling a switch function and the like is provided, and an axis insertion hole 41 penetrates a center thereof.

The switch main body 3 can be wholly constituted by integral molding.

Since the switch main body 3 is a member in which the locking mechanism 43 is provided, it has a meaning as a shaft inserted member.

Schematic Structure of the Operation Part

Figure 2:
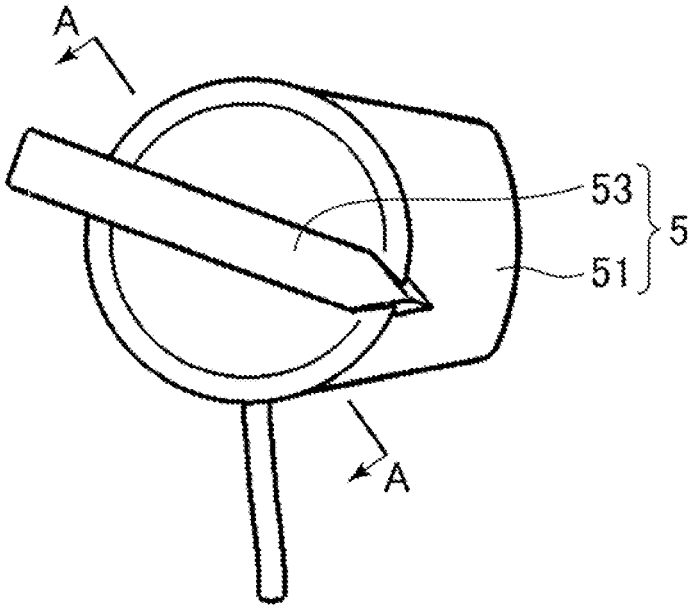
FIG. 2 is a planar view of the switch.

As illustrated in FIGS. 1 to 3, the operation part 5 externally includes: a substantially cylindrical operation part main body 51; and an arrow-shaped instruction part 53 provided so as to traverse a top face of the operation part main body 51.

The arrow-shaped instruction part 53 is a part for selectively indicating if the switch 1 is on or off.

Shaft Slip-Off Stopping Structure on the Shaft Side

Figure 6:
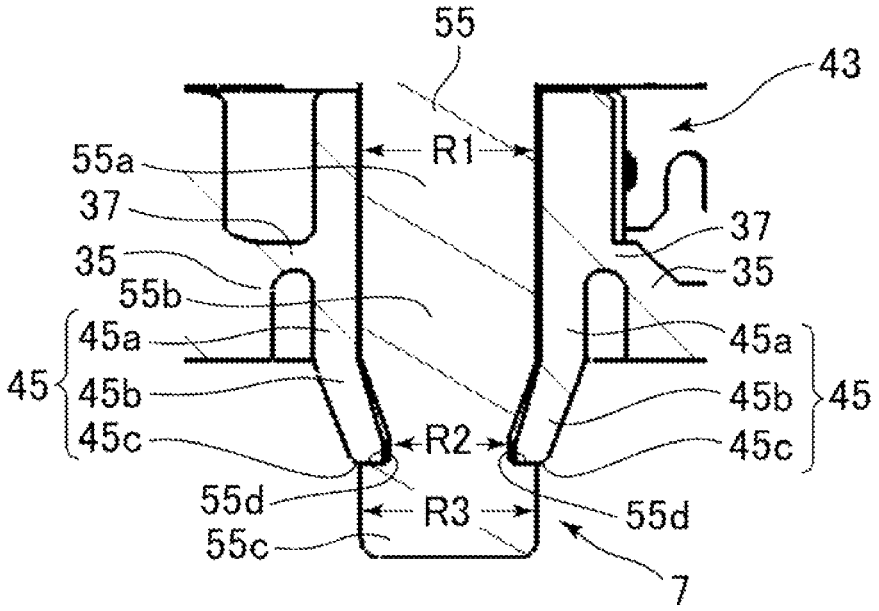
FIG. 6 is an enlarged view of a shaft slip-off stopping structure illustrated in FIG. 1.

As illustrated in FIGS. 1 and 6, a shaft 55 projecting in a direction of the switch main body 3 is integrally formed in a central part on a back side of the operation part main body 51.

The shaft 55 includes toward a tip thereof in order: a base shaft portion 55*a* having a diameter R1 and projecting from the operation part 5 (operation part main body 51); a tapered portion 55*b* in which the diameter R1 is gradually reduced to a diameter R2 (R2<R1); and a locking portion 55*c* having a diameter R3 (R3>R2, R3=R1 in this embodiment).

Since diameters are different between adjacent parts in this way (and an annular groove is formed), a locking step portion 55*d* is formed between the tapered portion 55*b*, being a tip portion of the shaft 55, and the locking portion 55*c*.

The locking step portion 55*d* constitutes a part on the shaft 55 side in the shaft slip-off stopping structure 7.

Shaft Slip-Off Stopping Structure on the Switch Main Body Side

As illustrated in FIG. 1 and FIGS. 4 to 6, the locking mechanism 43 includes a plurality of locking pieces 45 supported by the thick plate portion 35.

At least two locking pieces 45 may be provided. In this embodiment, there are provided four locking pieces of the same type positioned at an equal interval in a circumferential direction.

It is preferable that each of the locking pieces 45 have elasticity.

Each of the locking pieces 45 having elasticity, by using elastic force thereof, can rotatably and elastically clamp the shaft 55 in a cooperative manner.

A space surrounded by each of the locking pieces 45 is substantially concentric with the axis insertion hole 41.

The locking piece 45 is a plate-shaped member having a doglegged section, and includes a base shaft clamping portion (base part) 45*a* and a taper clamping portion (tip locking portion) 45*b*.

As illustrated in FIGS. 1 and 4, an inner surface of the base shaft clamping portion 45*a* is formed into a shape along an outer periphery surface of the base shaft portion 55*a* of the shaft 55, and an inner surface of the taper clamping portion 45*b* is formed into a shape along the tapered portion 55*b*, respectively (that is, formed into a curved surface having substantially the same curvature as the shaft 55).

This is for making rotation (relative move) of the shaft 55 inserted through the axis insertion hole 41 smooth, and further for increasing an effect of suppressing axial deflection by increasing a contact area between the two as much as possible.

Therefore, an upper part 45*d* of the base shaft clamping portion 45*a* functions as a bearing structure for supporting the shaft 55 penetrating therein without hindering the rotation thereof.

Note that an open end of the taper clamping portion 45*b* forms a tip portion 45*c*.

The locking piece 45 is configured to be elastically deformable as a whole. Accordingly, the locking piece 45 can cooperatively clamp the shaft 55 while allowing the rotation thereof.

That is, as illustrated in FIG. 6, a distance between the opposing base shaft clamping portions 45*a* is arranged to be slightly shorter than the largest diameter of the shaft 55 (e.g., diameter R1). Accordingly, the shaft 55 is inserted by slightly expanding the distance therebetween.

Elasticity of the locking piece 45 allows for this expanding.

Furthermore, the shortest distance between the taper clamping portions 45*b* is shorter than the distance between the base shaft clamping portions 45*a*, whereby the locking portion 55*c* of the shaft 55 largely expands the distance and passes therethrough.

After the passage, the taper clamping portion 45*b* is elastically returned and returns to an original position.

At that time, by a distance between the tip portions 45*c* becoming shorter than the diameter R3 of the locking portion 55*c*, the tip portion 45*c* engages with the locking step portion 55*d* formed between the locking portion 55*c* and the tapered portion 55*b*, whereby slip-off stopping is performed.

Note that, in FIGS. 1 and 6, the slip-off stopping is performed in a state where the tip portion 45*c* abuts on the locking step portion 55*d*; however, there may be a slight gap between the two.

In that case, the tip portion 45*c* abuts when the shaft 55 is moved in a pulling out direction.

Functions and Effects Unique to this Embodiment

Following functions and effects are generated by the switch 1 according to this embodiment.

First, the shaft 55 is molded integrally with the operation part 5 (operation part main body 51), whereby it can be manufactured in one shot, and the number of components can be decreased.

Therefore, it is possible to reduce a component cost.

Furthermore, the switch 1 can be assembled only by inserting the shaft 55 into the axis insertion hole 41 of the switch main body 3 while holding the operation part 5, and by pressing it against the elastic force of the locking piece 45.

It is very easy because the slip-off stopping is performed in a direction opposite to an insertion direction by cooperation of the locking piece 45 and the shaft 55 while cancelation of the slip-off stopping is prevented by the elastic force.

Therefore, it is also possible to reduce as labor cost.

Furthermore, since the locking piece 45 elastically clamps the shaft 55 in the cooperative manner, it contributes to a stable rotation, and a length direction (vertical direction in FIG. 6) thereof is substantially parallel to the pulling out direction of the shaft 55.

Accordingly, the force received in a thickness direction in the above-described third conventional structure can be received in a length direction, whereby a load can be reduced.

In other words, sufficient strength can be maintained.

Modification According to this Embodiment and Overall Structure

Figure 7:
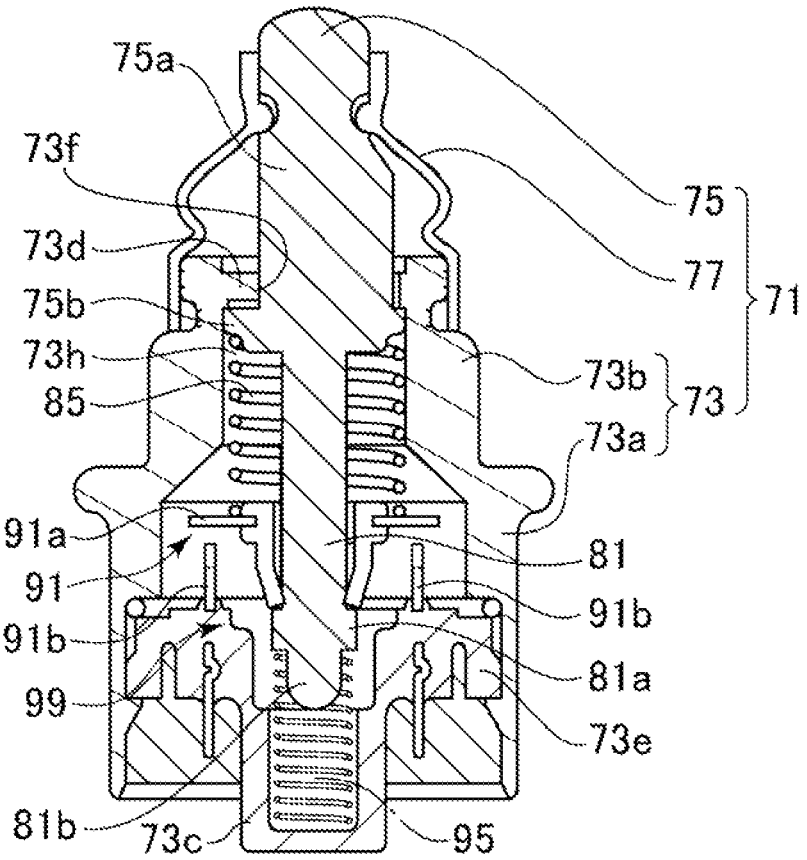
FIG. 7 is a sectional view of the assembled switch according to a modification.
Figure 8:
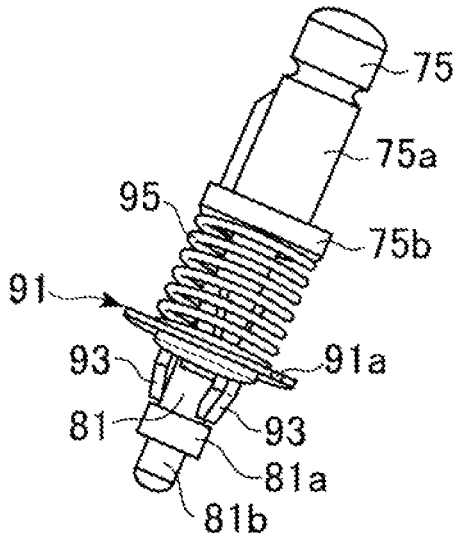
FIG. 8 is a perspective view illustrating a structure around a shaft of the switch illustrated in FIG. 7.

A switch 71 illustrated in FIGS. 7 and 8 is a push type switch externally including a switch main body 73, an operation part 75 retractably (relatively movably) integrated into the switch main body 73, and a cover member 77.

The cover member 77 is fixed to the switch main body 73, and is constituted so as to cover the switch main body 73 in a state where the operation part 75 is exposed from a conical apex.

The switch 71 is retracted into the switch main body 73 when the operation part 75 is pressed down with a finger, and is returned when the finger is released.

Structure Around the Operation Part

First, a structure around the operation part 75 is described.

As illustrated in FIGS. 7 and 8, the operation part 75 is formed to be a short length cylindrical shape. A cylinder part 75*a* having substantially the same diameter as the operation part 75, a ring-shaped flange part 75*b* having a larger diameter than that of the cylinder part 75*a*, and a shaft 81 having a smaller diameter than that of the ring-shaped flange part 75*b* (and a smaller diameter than that of the cylinder part 75*a*) are made of resin and are integrally molded to be concentric with each other.

Figure 9:
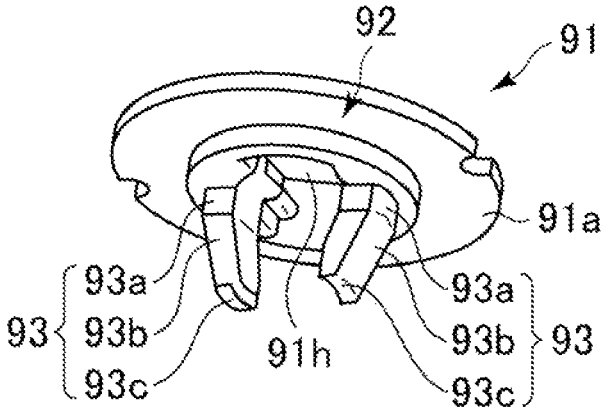
FIG. 9 is a perspective view of a movable member viewed from below.

A reference numeral 91 illustrated in FIGS. 7 to 9 denotes a movable member (shaft inserted member) integrally molded from resin.

The movable member 91 includes a metal movable contact point 91*a* having a circular center hole at the center thereof, a ring member 92 embedded into this center hole, and a plurality of (two in this modification) locking pieces 93 projecting out from one surface (undersurface in FIG. 9) of the ring member 92.

Each of the locking pieces 93 includes a base part 93*a* extending along a length direction of the shaft 81, and a tip locking portion 93*b* bending from a tip of the base part 93*a* and extending toward a center direction, and it is formed into a chevron shape as a whole.

Note that a through hole 91*h*, penetrating through a center of the ring member 92, has an inside diameter slightly smaller than an outside diameter of the shaft 81 described below. The elastic locking piece 93, by being elastically deformed, is constituted so as to allow insertion and slide in an axial direction of a flange part 81*a* during the insertion.

The above-described locking pieces 93 and the flange part 81*a* described below constitute a slip-off stopping structure 99 for preventing the shaft from slipping off in a direction opposite to an insertion direction (upward direction in FIG. 7) from the movable member 91 (FIG. 7).

Structure of Switch Main Body

As illustrated in FIG. 7, the switch main body 73 substantially includes a large diameter portion 73*a* and a small-diameter portion 73*b* above it, both of which are cylindrically shaped and concentric.

A spring receiving part 73*c* is provided so as to penetrate through a center of a bottom of the large-diameter portion 73*a*, and a small-diameter coil spring 95 is housed therein so as to be extensible and contractive in an axial direction.

An inside diameter of the small-diameter coil spring 95 is smaller than that of a tip portion Kb of the shaft 81, and an outside diameter thereof is formed to be smaller than that of the flange part 81*a*. Accordingly, the tip portion 81*b* can be inserted therein but cannot be moved above the flange part 81*a*.

At a central part of the switch main body 73, a vertical hole 73*h* through which the shaft 81 is penetrated is formed. The vertical hole 73*h* and the spring receiving part 73*c* are communicated inside.

At the top of the vertical hole 73*h*, there is provided a ring-shaped projection portion 73*d* having a through hole 73*f* at the center thereof.

An inside diameter of the through hole 73*f* is formed to be an inside diameter that allows a move of the cylinder part 75*a* of the operation part 75 in an axial direction. Accordingly, the ring-shaped projection portion 73*d*, through the cylinder part 75*a*, functions as a bearing structure for supporting the entire shaft 81 to be movable back and forth.

Note that a reference numeral 85 illustrated in FIG. 7 denotes a large-diameter coil spring surrounding the shaft 81 and being clamped between the ring-shaped flange part 75*b* and the movable contact point 91*a*.

A lower end of the large-diameter coil spring 85 is fixed to the movable contact point 91*a*.

Inside the large-diameter portion 73*a* of the switch main body 73, a contact point supporting stand 73*e* is provided. On an upper surface of the contact point supporting stand 73*e*, a pair of fixed contact points 91*b* and 9*n*, each having an upper part thereof exposed, is supported.

Each of the fixed contact points 91*b* and 91*b* is arranged to a position contactable with the movable contact point 91*a* that has moved down.

Modification and, Functions and Effects of this Embodiment

As illustrated in FIGS. 7 to 9, when an operator presses the operation part 75 down with a finger, the small-diameter coil spring 95 is compressed, and when the operator releases the finger, the operation part 75 is returned by elastic return of the small-diameter coil spring 95.

On the other hand, this pressing down causes the large-diameter coil spring 85 to be pushed down through the ring-shaped flange part 75*b*, whereby the movable contact point 91*a* is moved down accompanied by this.

The movable contact point 91*a* that has moved down eventually contacts the fixed contact points 91*b*, and furthermore, by compression accompanying the moving down of the large-diameter coil spring 85, is elastically pressed against the fixed contact points 91*b*.

The elastic pressing ensures contact between both of the fixed contact point 9*n* and the movable contact point 91*a*. Accordingly, one of the fixed contact points 91*b* and the other of the fixed contact points 91*b* are electrically connected, and the switch 71 is turned on.

It is returned to an original state by the operator releasing the finger as described above, and the on state is turned into an off state.

The slip-off stopping in the direction opposite to the insertion direction is performed by cooperation between the locking piece 93 and the shaft 81, whereby it has a very simple structure but a large effect.

The scope of the claims should not be limited by the preferred embodiments and examples, but should be given the broadest interpretation consistent with the specification as a whole.

What is claimed is:

1. A shaft slip-off stopping structure comprising:

(a) a shaft inserted member into which a shaft is inserted in a relatively movable manner;

(b) a locking mechanism being provided in the shaft inserted member;

(c) the shaft slip-off stopping structure being configured between a tip portion of the shaft and the locking mechanism in a direction opposite to an insertion direction, wherein the tip portion of the shaft includes the following portions towards a tip thereof in order: a base shaft portion having a diameter R1; a tapered portion in which the diameter R1 is gradually reduced to a diameter R2, the diameter R2 being less than the diameter R1, a locking step portion being formed by providing an annular groove or a ring-shaped projection portion, and a locking portion having a diameter R3, the diameter R3 being greater than the diameter R2;

(d) the locking mechanism including at least two locking pieces arranged around the shaft at an equal interval, and each of the locking pieces including a base part extending along a length direction of the shaft, and a tip locking portion bending from the base part and extending toward a center direction;

(e) an inner surface of a base shaft clamping portion being formed into a shape along an outer periphery surface of the base shaft portion of the shaft and an inner surface of a taper clamping portion being formed into a shape along the tapered portion respectively, and;

(f) the shaft being stopped from slipping off by a tip portion of each of the tip locking portions abutting on the locking step portion.

2. A switch having the shaft slip-off stopping structure according to claim 1, comprising:

(a) an operation part integrally provided in a base end portion on an opposite side of the tip portion of the shaft; and (b) a switch main body inside which the shaft inserted member is provided.

3. The switch according to claim 2, wherein the shaft is configured to be rotatable relative to the switch main body and the locking mechanism by operation of the operation part.

4. The switch according to claim 2, wherein the shaft is configured to be retractable relative to the switch main body and the locking mechanism by operation of the operation part.

5. The switch according to claim 4, wherein the shaft inserted member has a movable contact point configured to move in sync with retraction of the shaft.

* * * * *